US010805995B2

(12) United States Patent
Miyasaka et al.

(10) Patent No.: US 10,805,995 B2
(45) Date of Patent: Oct. 13, 2020

(54) LIGHT-EMITTING MODULE AND CONTROL MODULE

(71) Applicant: NICHIA CORPORATION, Anan-shi (JP)

(72) Inventors: Naohide Miyasaka, Suwa-gun (JP); Naoki Nakamura, Suwa-gun (JP); Minoru Kitahara, Suwa-gun (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 16/408,471

(22) Filed: May 10, 2019

(65) Prior Publication Data

US 2019/0364635 A1 Nov. 28, 2019

(30) Foreign Application Priority Data

May 24, 2018 (JP) ..... 2018-099467

(51) Int. Cl.

| | |
|---|---|
| ***H05B 45/10*** | (2020.01) |
| ***H05B 45/22*** | (2020.01) |
| ***H05B 45/40*** | (2020.01) |
| ***H05B 45/20*** | (2020.01) |
| ***H05B 33/02*** | (2006.01) |

(52) U.S. Cl.
CPC ..... *H05B 45/10* (2020.01); *H05B 45/22* (2020.01); *H05B 45/40* (2020.01)

(58) Field of Classification Search
CPC ..... H05B 45/20; H05B 33/02; H05B 33/12; H05B 47/16; H05B 47/105; H05B 47/11; H05B 47/19; H05B 33/10; H05B 33/14; H05B 45/10; H05B 45/22; H05B 47/12; H05B 45/00
See application file for complete search history.

(56) References Cited

U.S. PATENT DOCUMENTS

2009/0079359 A1* 3/2009 Shteynberg ..... H05B 45/37 315/291
2010/0060172 A1 3/2010 Ikebe et al.
(Continued)

FOREIGN PATENT DOCUMENTS

JP 2007-087816 4/2007
JP 2007-134194 5/2007
(Continued)

*Primary Examiner* — Wei (Victor) Y Chan
(74) *Attorney, Agent, or Firm* — Mori & Ward, LLP

(57) ABSTRACT

A light-emitting module includes a light emitter including a first semiconductor light-emitting element, a second semiconductor light-emitting element, and a third semiconductor light-emitting element. A first current regulator is to supply the first current to the first semiconductor light-emitting element. The second current regulator is to supply the second current to the second semiconductor light-emitting element. The third current regulator is to supply the third current to the third semiconductor light-emitting element. A control circuit is configured to control at least one of the first current regulator to control the first current, the second current regulator to control the second current, or control the third current regulator to control the third current according to at least one of fluctuation of the first voltage drop, fluctuation of the second voltage drop, or fluctuation of the third voltage drop.

18 Claims, 6 Drawing Sheets

(56) References Cited

U.S. PATENT DOCUMENTS

| | | | | |
|---|---|---|---|---|
| 2010/0301777 | A1 | 12/2010 | Kraemer | |
| 2011/0109228 | A1* | 5/2011 | Shimomura | H05B 47/185 315/113 |
| 2011/0115407 | A1* | 5/2011 | Wibben | H05B 45/44 315/294 |
| 2011/0241572 | A1 | 10/2011 | Zhang et al. | |
| 2016/0366746 | A1* | 12/2016 | van de Ven | F21V 7/00 |

FOREIGN PATENT DOCUMENTS

| | | |
|---|---|---|
| JP | 2008-135220 | 6/2008 |
| JP | 2008-140756 | 6/2008 |
| JP | 2010-538434 | 12/2010 |
| JP | 2013-524523 | 6/2013 |

* cited by examiner

LIGHT-EMITTING MODULE AND CONTROL MODULE

CROSS-REFERENCE TO RELATED APPLICATIONS

This application is based upon and claims the benefit of priority from Japanese Patent Application No. 2018-099467, filed on May 24, 2018; the entire contents of which are incorporated herein by reference.

BACKGROUND OF THE INVENTION

Field

Embodiments described herein relate to a light-emitting module and a control module.

Background

There is a light-emitting module that uses a semiconductor light-emitting element, for example, Japanese Patent Publication No. 2013-524523. Characteristics such as the light output, the chromaticity, etc., may shift when using the light-emitting module. It is difficult to obtain the desired light emission when the characteristics shift.

SUMMARY

According to one embodiment, a light-emitting module includes a light emitter, a first current regulator, a second current regulator, a third current regulator, and a control circuit. The light emitter includes a first semiconductor light-emitting element, a second semiconductor light-emitting element, and a third semiconductor light-emitting element. The first semiconductor light-emitting element is configured to emit a first light with a first current flowing through the first semiconductor light-emitting element to cause a first voltage drop over the first semiconductor light-emitting element. The second semiconductor light-emitting element is configured to emit a second light with a second current flowing through the second semiconductor light-emitting element to cause a second voltage drop over the second semiconductor light-emitting element. The third semiconductor light-emitting element is configured to emit a third light with a third current flowing through the third semiconductor light-emitting element to cause a third voltage drop over the third semiconductor light-emitting element. The first current regulator is electrically connected to the first semiconductor light-emitting element to supply the first current to the first semiconductor light-emitting element. The second current regulator is electrically connected to the second semiconductor light-emitting element to supply the second current to the second semiconductor light-emitting element. The third current regulator is electrically connected to the third semiconductor light-emitting element to supply the third current to the third semiconductor light-emitting element. The control circuit is configured to control at least one of the first current regulator to control the first current, the second current regulator to control the second current, or control the third current regulator to control the third current according to at least one of fluctuation of the first voltage drop, fluctuation of the second voltage drop, or fluctuation of the third voltage drop.

According to another embodiment of the present invention, a control module includes a first current regulator, a second current regulator, a third current regulator, and a control circuit. The first current regulator is to supply a first current to a first semiconductor light-emitting element configured to emit a first light to cause a first voltage drop over the first semiconductor light-emitting element. The second current regulator is to supply a second current to a second semiconductor light-emitting element configured to emit a second light to cause a second voltage drop over the second semiconductor light-emitting element. The third current regulator is to supply a third current to a third semiconductor light-emitting element configured to emit a third light to cause a third voltage drop over the third semiconductor light-emitting element. The control circuit is to control at least one of the first current regulator to control the first current, the second current regulator to control the second current, or the third current regulator to control the third current according to at least one of fluctuation of the first voltage drop, fluctuation of the second voltage drop, or fluctuation of the third voltage drop.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF EMBODIMENTS

Figure 1:
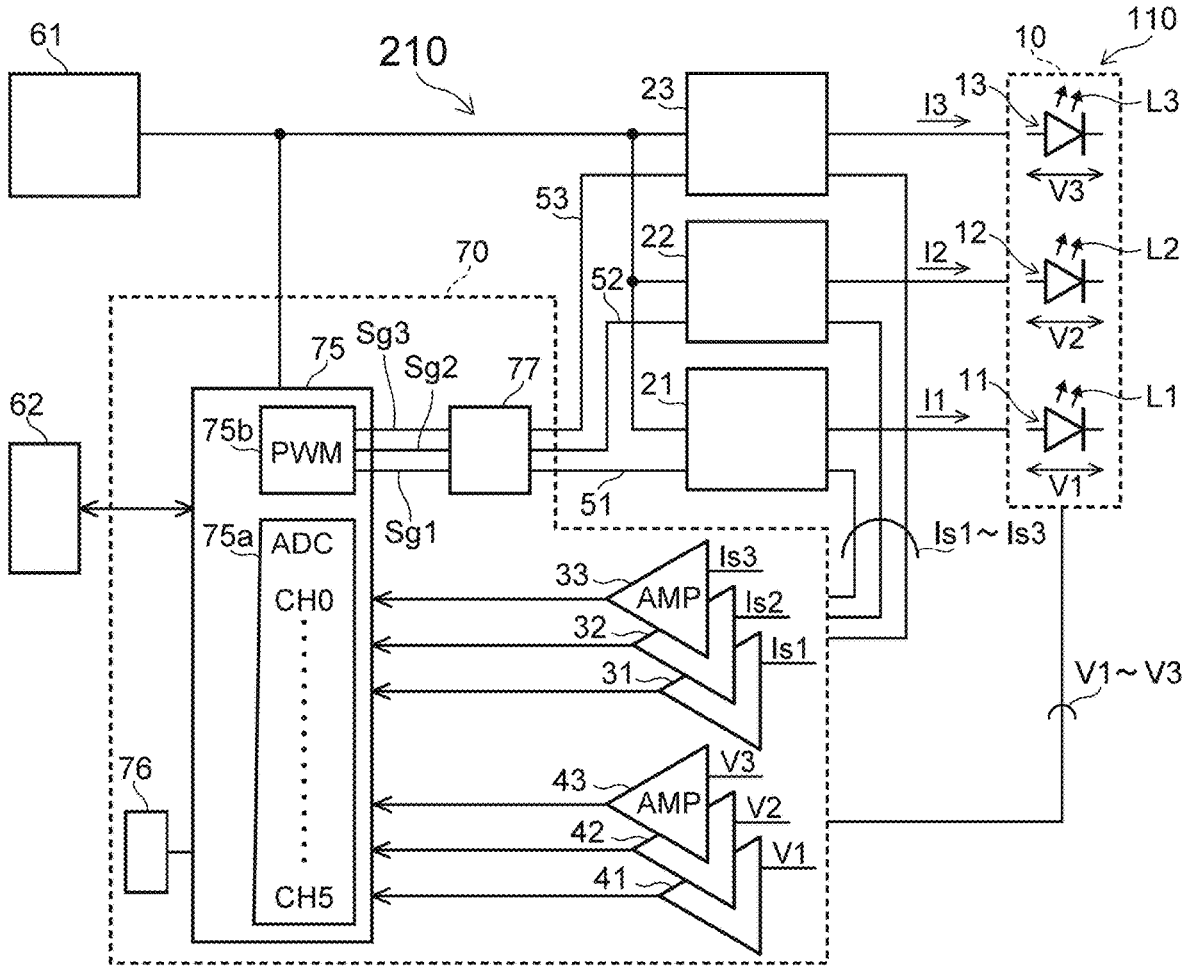
FIG. 1 is a schematic view illustrating a light-emitting module according to a first embodiment.

The embodiments will now be described with reference to the accompanying drawings, wherein like reference numerals designate corresponding or identical elements throughout the various drawings.

The invention provides a light-emitting module and a control module in which the desired characteristics can be obtained easily.

Various embodiments are described below with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

First Embodiment

FIG. 1 is a schematic view illustrating a light-emitting module according to a first embodiment.

As shown in FIG. 1, the light-emitting module 110 according to the embodiment includes a light emitter 10, first to third circuits 21 to 23, and a control circuit 70.

For example, a power supply portion 61 is connected to the first to third circuits 21 to 23 and the control circuit 70. For example, the power supply portion 61 supplies direct current voltages (direct currents) to these circuits. The power supply portion 61 may be included in the light-emitting module 110. Or, the power supply portion 61 may be provided separately from the light-emitting module 110.

The light emitter 10 includes, for example, the first to third semiconductor light-emitting elements 11 to 13. The first semiconductor light-emitting element 11 is configured to emit a first light L1 having a first peak wavelength. The second semiconductor light-emitting element 12 is configured to emit a second light L2 having a second peak wavelength. The third semiconductor light-emitting element 13 is configured to emit a third light L3 having a third peak wavelength. The first to third semiconductor light-emitting elements 11 to 13 are, for example, LEDs (light-emitting diodes).

For example, the second peak wavelength is different from the first peak wavelength. The third peak wavelength is different from the first peak wavelength and different from the second peak wavelength. For example, the colors of the first to third lights L1 to L3 are different from each other.

In one example, the second peak wavelength is longer than the first peak wavelength. The third peak wavelength is longer than the second peak wavelength. For example, the first peak wavelength is not less than 440 nm and not more than 490 nm. For example, the second peak wavelength is not less than 500 nm and not more than 560 nm. For example, the third peak wavelength is not less than 600 nm and 650 nm.

For example, the first light L1 is blue; the second light L2 is green; and the third light L3 is red. For example, the synthesized light of the first to third lights L1 to L3 is substantially white (a substantially achromatic). In the embodiment, light of any color may be obtained using these lights.

The first circuit 21 is electrically connected to the first semiconductor light-emitting element 11. The second circuit 22 is electrically connected to the second semiconductor light-emitting element 12. The third circuit 23 is electrically connected to the third semiconductor light-emitting element 13. These circuits are, for example, constant current drivers. A first current I1 is supplied from the first circuit 21 to the first semiconductor light-emitting element 11. A second current I2 is supplied from the second circuit 22 to the second semiconductor light-emitting element 12. A third current I3 is supplied from the third circuit 23 to the third semiconductor light-emitting element 13. The intensity (the luminous flux (units: lumen (lm))) of the light (the first to third lights L1 to L3) radiated from the first to third semiconductor light-emitting elements 11 to 13 is controllable based on the first to third currents I1 to I3. The first to third currents I1 to I3 are forward currents If (forward-direction currents).

A forward voltage Vf (a forward voltage or a forward voltage drop) of the first semiconductor light-emitting element 11 when the first current I1 is supplied to the first semiconductor light-emitting element 11 is a first voltage (a first voltage drop) V1. The forward voltage Vf of the second semiconductor light-emitting element 12 when the second current I2 is supplied to the second semiconductor light-emitting element 12 is a second voltage (a second voltage drop) V2. The forward voltage Vf of the third semiconductor light-emitting element 13 when the third current I3 is supplied to the third semiconductor light-emitting element 13 is a third voltage (a third voltage drop) V3.

The control circuit 70 can cause at least one of the first to third currents I1 to I3 to fluctuate according to the fluctuation of at least one of the first to third voltages V1 to V3 based on the first current I1 flowing in the first semiconductor light-emitting element 11, the first voltage V1 of the first semiconductor light-emitting element 11, the second current I2 flowing in the second semiconductor light-emitting element 12, the second voltage V2 of the second semiconductor light-emitting element 12, the third current I3 flowing in the third semiconductor light-emitting element 13, and the third voltage V3 of the third semiconductor light-emitting element 13.

For example, first to third current signals Is1 to Is3 and the first to third voltages V1 to V3 are input to the control circuit 70. The first to third current signals Is1 to Is3 are signals corresponding respectively to the first to third currents I1 to I3 flowing in the first to third semiconductor light-emitting elements 11 to 13. It is possible to obtain the first to third current signals Is1 to Is3 from the first to third circuits 21 to 22. The first to third voltages V1 to V3 can be obtained from the first to third semiconductor light-emitting elements 11 to 13.

In the example, first to third current amplifiers 31 to 33 are provided in the control circuit 70. The first current signal Is1 is input to the first current amplifier 31. The second current signal Is2 is input to the second current amplifier 32. The third current signal Is3 is input to the third current amplifier 33. These amplifiers are differential amplifiers for the forward currents If. The first to third currents I1 to I3 are derived from the first to third current signals Is1 to Is3.

In the example, first to third voltage amplifiers 41 to 43 are provided in the control circuit 70. The first voltage V1 is input to the first voltage amplifier 41. The second voltage V2 is input to the second voltage amplifier 42. The third voltage V3 is input to the third voltage amplifier 43. These amplifiers are differential amplifiers for the forward voltages Vf.

In the example, a MCU (Micro Controller Unit) 75 is provided in the control circuit 70. An ADC (Analog-to-Digital Converter) 75*a* and a PWM (Pulse Width Modulator) 75*b* are provided in the MCU 75. For example, the output of the first to third current amplifiers 31 to 33 and the output of the first to third voltage amplifiers 41 to 43 are input to the ADC 75*a*. For example, input channels CH0 to CH5 are provided in the ADC 75*a*. The output of the first to third current amplifiers 31 to 33 and the output of the first to third voltage amplifiers 41 to 43 are input to the input channels CH0 to CH5.

The output of the ADC 75*a* is input to the PWM 75*b*. First to third signals Sg1 to Sg3 are output from the PWM 75*b*. In the example, a LPF (low pass filter) 77 is provided in the control circuit 70. The first to third signals Sg1 to Sg3 pass through the PWM 75*b* and become first to third control signals 51 to 53. The first control signal 51 is input to the first circuit 21. The second control signal 52 is input to the second circuit 22. The third control signal 53 is input to the third circuit 23. The first to third currents I1 to I3 that are output from the first to third circuits 21 to 23 are controlled according to these control signals.

In the embodiment, memory 76 may be provided in the control circuit 70. Various programs and various data relating to the control circuit 70 may be stored in the memory 76. The memory 76 may be provided separately from the control circuit 70.

A computer 62 may be connected to the control circuit 70 as necessary. The control circuit 70 may be controlled by the computer 62. Data may be supplied from the control circuit 70 to the computer 62. For example, the communication between the control circuit 70 and the computer 62 may be performed by providing a UART (Universal Asynchronous Receiver/Transmitter) in the control circuit 70.

As recited above, the control circuit 70 controls the first to third circuits 21 to 23 by the first to third control signals 51 to 53. The first to third circuits 21 to 23 are controlled by the control circuit 70; and the first to third currents I1 to I3 that are supplied from the first to third circuits 21 to 23 to the first to third semiconductor light-emitting elements 11 to 13 can be controlled independently. As a result, as recited above, the intensity (e.g., the luminous flux) of the light radiated from the first to third semiconductor light-emitting elements 11 to 13 is controlled.

For example, when a semiconductor light-emitting element is continuously operated, the temperature of the semiconductor light-emitting element (e.g., the junction) increases. When the temperature changes, the light emission characteristics of the semiconductor light-emitting element change; and the intensity (e.g., the luminous flux) and the chromaticity of the light radiated from the semiconductor light-emitting element change. For example, in the case where white is obtained from the synthesized light using the three types of semiconductor light-emitting elements of blue, green, and red, a problem occurs easily because the chromaticity of the synthesized light shifts when the intensity or the chromaticity of the light changes when operating.

In the embodiment, based on the relationship between the current and the voltage of the semiconductor light-emitting element, the current (the forward current If) that is supplied to the semiconductor light-emitting element is caused to fluctuate according to the fluctuation of the voltage (the forward voltage Vf) of the semiconductor light-emitting element. For example, a unique relationship between the voltage and the current of the semiconductor light-emitting element exists. For example, the unique relationship between the voltage and the current also includes changes due to temperature. By knowing the current, the voltage, and the fluctuation of the voltage of the semiconductor light-emitting element, the current is controlled according to the fluctuation of the voltage. In other words, a correction of the current is performed. Thereby, the intensity (e.g., the luminous flux) and the chromaticity of the light from the semiconductor light-emitting element can approach the desired state (e.g., the state before the fluctuation). For example, the intensity (e.g., the luminous flux) and the chromaticity of the light substantially can be maintained.

An example of an operation of the light-emitting module 110 according to the embodiment will now be described. In the following example, the first to third lights L1 to L3 that are emitted from the first to third semiconductor light-emitting elements 11 to 13 are respectively blue, green, and red. The following description uses the XYZ colorimetric system (CIE 1931 colorimetric system; the xy chromaticity coordinates).

In the following description, the initial stable state of operating each semiconductor light-emitting element is taken as a first state. The state after continuing the operation of the semiconductor light-emitting element is taken as a second state. The first state is the "operation initial state." The second state is the "continued-operation state." In the example, the temperature of the semiconductor light-emitting element in the second state is higher than the temperature of the semiconductor light-emitting element in the first state. The current that is supplied to the semiconductor light-emitting element in the second state is the same as the current supplied to the semiconductor light-emitting element in the first state. In other words, each semiconductor light-emitting element has constant current driving. These currents are called the "pre-correction currents" for convenience.

On the other hand, the state when the current is modified (corrected) at the temperature of the second state is taken as a third state. The current that is supplied to the semiconductor light-emitting element in the third state is modified (corrected) by the control circuit 70. This current is called the "post-correction current" for convenience.

To simplify the description, the synthesized light of the first to third lights L1 to L3 is taken to be substantially white in the first state (the operation initial state). The chromaticity of the synthesized light in the first state is substantially (0.33, 0.33).

Figure 2:
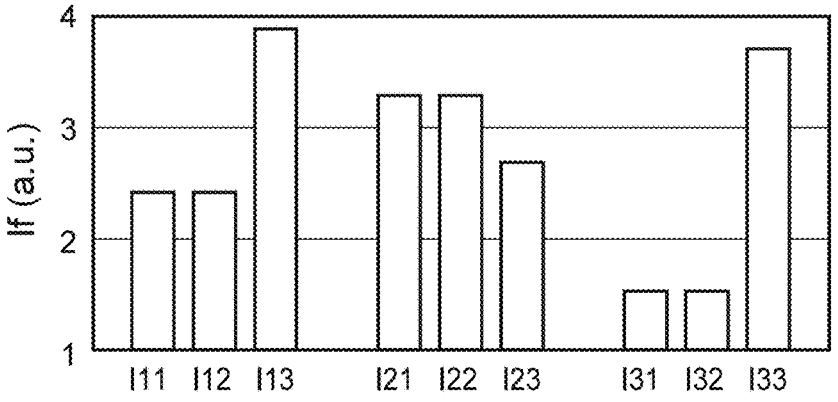
FIG. 2 is a schematic view illustrating the operation of the light-emitting module according to the first embodiment.

FIG. 2 is a schematic view illustrating the operation of the light-emitting module according to the first embodiment.

The horizontal axis of FIG. 2 corresponds to the currents supplied to the first to third semiconductor light-emitting elements 11 to 13 in the first to third states. The vertical axis is the forward current If (a. u.).

In the first state as shown in FIG. 2, a current I11 is supplied to the first semiconductor light-emitting element 11; a current I21 is supplied to the second semiconductor light-emitting element 12; and a current I31 is supplied to the third semiconductor light-emitting element 13. In the example, the synthesized light in the first state (the operation initial state) is substantially white due to such currents. The relationship relating to the three currents recited above is an example; and the relationship of the three currents in the first state of the embodiment is arbitrary.

In the second state, a current I12 is supplied to the first semiconductor light-emitting element 11; a current I22 is supplied to the second semiconductor light-emitting element 12; and a current I32 is supplied to the third semiconductor light-emitting element 13. As described above, the current I12 is the same as the current I11; the current I22 is the same as the current I21; and the current I32 is the same as the current I31. The currents (the post-correction currents) of the third state are described below.

Figure 3:
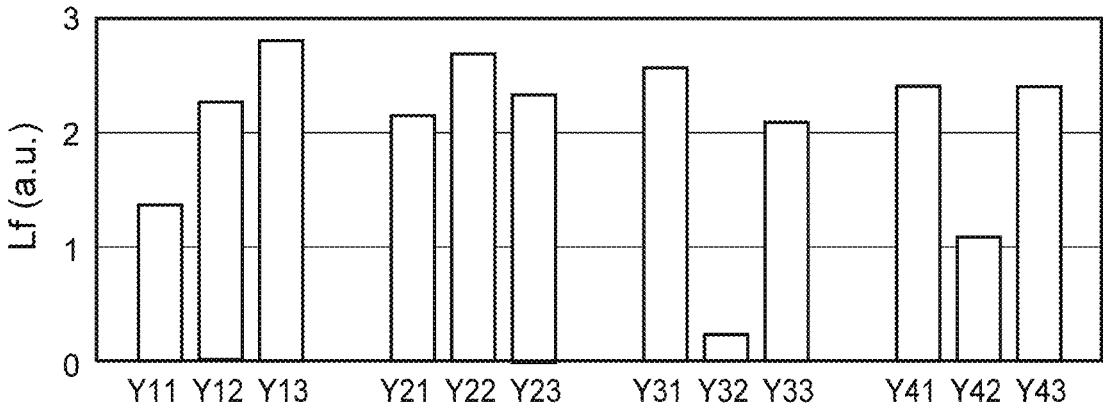
FIG. 3 is a schematic view illustrating the operation of the light-emitting module according to the first embodiment.

FIG. 3 is a schematic view illustrating the operation of the light-emitting module according to the first embodiment.

FIG. 3 illustrates a luminous flux Lf of the first to third lights L1 to L3. The horizontal axis of FIG. 3 corresponds to the luminous fluxes Lf in the first to third states of the first to third lights L1 to L3 recited above. FIG. 3 shows an example of measurement results of a luminous flux Y11 in the first state of the first light L1, a luminous flux Y12 in the second state of the first light L1, a luminous flux Y21 in the first state of the second light L2, a luminous flux Y22 in the second state of the second light L2, a luminous flux Y31 in the first state of the third light L3, a luminous flux Y32 in the second state of the third light L3, a luminous flux Y41 in the first state of the synthesized light, and a luminous flux Y42 in the second state of the synthesized light. The vertical axis of FIG. 3 is the luminous flux Lf (a. u.).

As shown in FIG. 3, for the first light L1 (blue), the luminous flux Y12 in the second state (the continued-operation state) increases compared to the luminous flux Y11 in the first state (the operation initial state). For the second light L2 (green), the luminous flux Y22 in the second state increases compared to the luminous flux Y21 in the first state. For the third light L3 (red), the luminous flux Y32 in the second state decreases compared to the luminous flux Y31 in the first state. For the synthesized light, the luminous flux Y42 in the second state decreases compared to the luminous flux Y41 in the first state.

The difference (the change; the shift) of the values between the first state and the second state is based on at least one of a change of the peak wavelength, a change of the full width at half maximum, a change of the radiant flux, or a change of the skewness for the first to third lights L1 to L3. The lights in the third state are described below.

Figure 4:
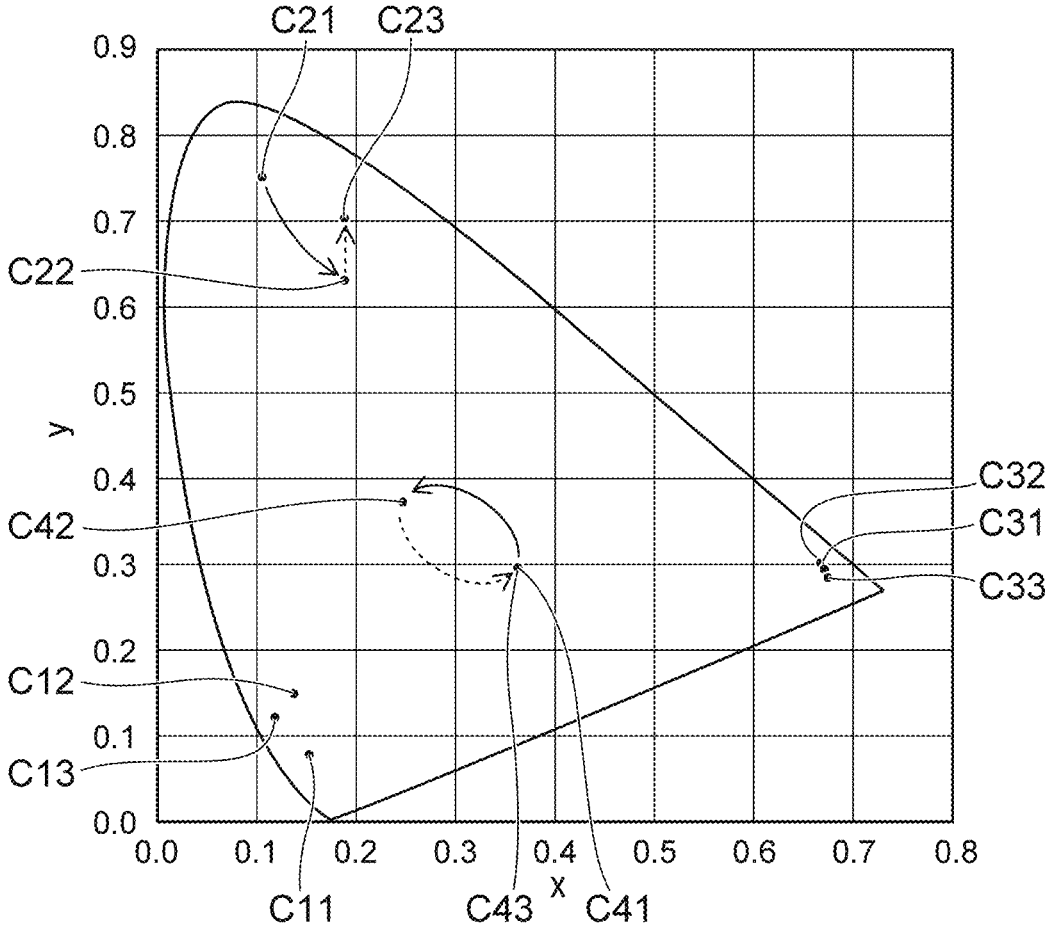
FIG. 4 is a schematic view illustrating the operation of the light-emitting module according to the first embodiment.

FIG. 4 is a schematic view illustrating the operation of the light-emitting module according to the first embodiment.

FIG. 4 is a xy chromaticity diagram showing the chromaticities in the first to third states of the first to third lights L1 to L3 recited above. The horizontal axis of FIG. 4 is the chromaticity x; and the vertical axis is the chromaticity y. FIG. 4 shows an example of measurement results of a chromaticity C11 in the first state of the first light L1, a chromaticity C12 in the second state of the first light L1, a chromaticity C21 in the first state of the second light L2, a chromaticity C22 in the second state of the second light L2, a chromaticity C31 in the first state of the third light L3, a chromaticity C32 in the second state of the third light L3, a chromaticity C41 in the first state of the synthesized light, and a chromaticity C42 in the second state of the synthesized light.

As shown in FIG. 4, the chromaticities of these lights in the second state are shifted from the chromaticities of these lights in the first state. The shift of these chromaticities is based on at least one of a change of the peak wavelength, a change of the full width at half maximum, a change of the radiant flux, or a change of the skewness for the first to third lights L1 to L3.

Thus, when the first state changes to the second state, the luminous flux Lf (referring to FIG. 3) and the chromaticity (referring to FIG. 4) shift. It is considered that such shifts are related to the shift (the fluctuation) of the forward voltages Vf of the semiconductor light-emitting elements between the first state and the second state. It is considered that the shift of the forward voltages Vf is related to, for example, a change of the characteristics (e.g., the energy levels) of the semiconductor light-emitting elements.

Figure 5:
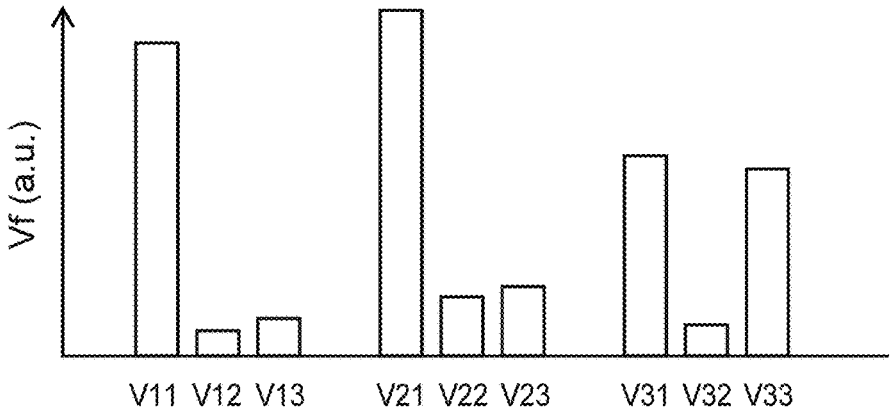
FIG. 5 is a schematic view illustrating the operation of the light-emitting module according to the first embodiment.

FIG. 5 is a schematic view illustrating the operation of the light-emitting module according to the first embodiment.

The horizontal axis of FIG. 5 corresponds to the forward voltages Vf of the first to third semiconductor light-emitting elements 11 to 13 in the first to third states. The vertical axis is the forward voltage Vf (a. u.). FIG. 5 shows an example of measurement results of the forward voltages Vf in the first to third states. In the example, the first to third semiconductor light-emitting elements 11 to 13 are provided on one substrate.

For the first semiconductor light-emitting element 11 as shown in FIG. 5, a voltage V12 in the second state is lower than a voltage V11 in the first state. For the second semiconductor light-emitting element 12, a voltage V22 in the second state is lower than a voltage V21 in the first state. For the third semiconductor light-emitting element 13, a voltage V32 in the second state is lower than a voltage V31 in the first state. In the example, such a shift of the forward voltages Vf is based on a change of the characteristics (e.g., the energy levels, etc.) of the semiconductor light-emitting elements between the first state and the second state. For example, the change of the characteristics is related to the change of the temperature. In the example, the temperature of the second state is higher than the temperature of the first state. In the embodiment, the states of the temperature may be reversed. In such a case, the direction of the shift of the forward voltage Vf is reversed. The forward voltages Vf in the third state are described below.

Thus, the forward voltage Vf shifts (fluctuates) when the state changes. The shifts of the luminous flux Lf (referring to FIG. 3) and the chromaticity (referring to FIG. 4) are related to the shift (the fluctuation) of the forward voltage Vf of each semiconductor light-emitting element.

In the embodiment, the currents are caused to fluctuate according to the fluctuation of the voltages based on the first current I1, the first voltage V1, the second current I2, the second voltage V2, the third current I3, and the third voltage V3. As described above, due to the constant current driving, the first to third currents I1 to I3 recited above are the currents in the first state (the operation initial state) or the second state (the continued-operation state). Practically, the first to third currents I1 to I3 may be the current I12, the current I22, and the current I32 (the measured values of these currents) in the second state (the continued-operation state). On the other hand, the first voltage V1, the second voltage V2, and the third voltage V3 are respectively the voltage V12, the voltage V22, and the voltage V32 (the measured values of these voltages) in the second state.

In the embodiment, at least one of the first to third currents I1 to I3 is caused to fluctuate according to the fluctuation of at least one of the first to third voltages V1 to V3 based on the currents and the voltages of the second state recited above.

For example, the luminous flux and the chromaticity can be calculated (estimated) for the first to third lights L1 to L3 and the synthesized light in the second state based on the currents and the voltages of the second state recited above. The calculation is performed based on information relating to the light output, the peak wavelength, the full width at half maximum of the spectral characteristic, and the skewness of the spectral characteristic when the temperature and the forward current If are changed for the first to third semiconductor light-emitting elements 11 to 13.

For this information, for example, the characteristics of the first to third semiconductor light-emitting elements 11 to 13 are actually measured; and the actual measurement results are stored in memory (e.g., the memory 76 referring to FIG. 1). Or, an approximation formula is derived from the actual measurement results; and the parameters (the coefficients) of the approximation formula are stored in memory. The memory may be provided inside the control circuit 70; or the memory may be provided separately from the control circuit 70. The memory is provided in any server (which may be, for example, the computer 62); and the information that is stored in the memory may be acquired by any method. The information of the first to third semiconductor light-emitting elements 11 to 13 recited above may be information relating to the semiconductor light-emitting elements included in the light-emitting module 110 which is the object, or may be information relating to a semiconductor light-emitting element having the same design as the semiconductor light-emitting elements included in the light-emitting module 110 which is the object.

Based on the information, the luminous flux and the chromaticity can be calculated for the first to third lights L1 to L3 and the synthesized light in the second state based on the currents and the voltages of the second state recited above. The current is caused to fluctuate according to the fluctuation of the voltage so that the luminous flux and the chromaticity that are calculated approach the first state.

Green will be focused upon as an example. Green has a large effect on visibility for a human. For example, as shown in FIG. 5, the voltage V22 in the second state of the second semiconductor light-emitting element 12 is lower than the voltage V21 in the first state of the second semiconductor light-emitting element 12. Thus, the second voltage V2 fluctuates between the first state and the second state. In the example, the second voltage V2 decreases. At this time, for example, as shown in FIG. 2, the control circuit 70 reduces the second current I2 from the current I22 to a current I23 according to the decrease of the second voltage V2.

Thereby, as illustrated in FIG. 3, a luminous flux Y23 in the third state of the second light L2 from the second semiconductor light-emitting element 12 approaches the luminous flux Y21 in the first state.

Simultaneously, as shown in FIG. 4, a chromaticity C23 of the second light L2 in the third state moves from the chromaticity C22 in the second state to the chromaticity C23 in the third state. The chromaticity C23 does not perfectly match the chromaticity C21 in the first state.

Thus, even when the second current I2 is reduced according to the decrease of the second voltage V2 in the third state and the luminous flux Y23 of the second light L2 approaches the luminous flux Y21 in the first state, the chromaticity C23 of the second light L2 in the third state is separated from the chromaticity C21 in the first state. The chromaticity of the synthesized light (white) shifts because the chromaticity of the second light L2 (green) shifts.

In the embodiment, the control circuit 70 controls the currents of the other semiconductor light-emitting elements according to the decrease of the second voltage V2 of the second semiconductor light-emitting element 12. For example, according to the decrease of the second voltage V2 of the second semiconductor light-emitting element 12, the first current I1 of the first semiconductor light-emitting element 11 is increased; and the third current I3 of the third semiconductor light-emitting element 13 is increased.

For example, as shown in FIG. 2, the control circuit 70 increases the first current I1 from the current I12 to a current I13 and increases the third current I3 from the current I32 to a current I33 according to the decrease of the second voltage V2.

Thereby, as shown in FIG. 4, a chromaticity C13 of the first light L1 in the third state is shifted from the chromaticity C12 in the second state. A chromaticity C33 of the third light L3 in the third state is shifted from the chromaticity C32 in the second state (in the example, the shift of the chromaticity is small on the chromaticity diagram). Due to such a shift of the chromaticity of the first light L1 and such a shift of the chromaticity of the third light L3, a chromaticity C43 of the synthesized light in the third state approaches the chromaticity C41 of the synthesized light in the first state. The chromaticity of the synthesized light is corrected and the original (the first state) chromaticity is obtained.

Thus, in the embodiment, by controlling (correcting) the current according to the decrease of the voltage, the luminous flux Lf and the chromaticity that changed from the first state (the operation initial state) to the second state (the continued-operation state) can approach the first state.

By repeating the operation recited above, the luminous flux Lf and the chromaticity can approach the first state (the operation initial state) better.

In the embodiment, it is favorable for the correction to be referenced to a color that is highly visible to a human (a peak wavelength that is highly visible). For example, in the case where the second light L2 is green, it is favorable for the current to be corrected according to the fluctuation (e.g., the decrease or the increase) of the second voltage V2 corresponding to the second light L2.

For example, in the example as shown in FIG. 3, a luminous flux Y13 of the first light L1 in the third state is even higher than the luminous flux Y12 of the first light L1 in the second state. The luminous flux Y23 of the second light L2 in the third state is near the luminous flux Y21 of the second light L2 in the first state compared to the luminous flux Y22 of the second light L2 in the second state. A luminous flux Y33 of the third light L3 in the third state increases from the luminous flux Y32 of the third light L3 in the second state and approaches the luminous flux Y31 of the third light L3 in the first state. A luminous flux Y43 of the synthesized light in the third state increases from the luminous flux Y42 of the synthesized light in the second state and approaches the luminous flux Y41 (the target value) of the synthesized light in the first state.

In the example as shown in FIG. 5, a voltage V13 of the first semiconductor light-emitting element 11 in the third state is slightly higher than the voltage V12 of the first semiconductor light-emitting element 11 in the second state. In the example, a voltage V23 of the second semiconductor light-emitting element 12 in the third state is slightly higher than the voltage V22 of the second semiconductor light-emitting element 12 in the second state. A voltage V33 of the third semiconductor light-emitting element 13 in the third state is much higher than the voltage V32 of the third semiconductor light-emitting element 13 in the second state.

On the other hand, a first reference example may be considered in which the light that is radiated from the semiconductor light-emitting elements is detected by a light sensor; and the semiconductor light-emitting elements are controlled based on the result. By this method, there is a possibility that the shift of the luminous flux Lf and the chromaticity can be corrected when operating. However, in the first reference example, a light sensor is necessary; and the number of components increases.

On the other hand, there is a second reference example in which the temperature of the semiconductor light-emitting elements is determined; and the semiconductor light-emitting elements are controlled based on the result. For example, the temperature of the semiconductor light-emitting elements is determined by providing a diode that thermally approaches the semiconductor light-emitting elements, and by determining the junction temperature of the diode. In such a case, the other element (in the example recited above, the diode) for measuring the temperature of the semiconductor light-emitting elements is necessary; and the number of components increases. There are also cases where the temperature is determined based on, for example, a template and measurement results of the voltages of the semiconductor light-emitting elements. The currents that flow in the semiconductor light-emitting elements are adjusted using the template and the determined temperature. Even in such a case, the correction is performed using the temperature.

Conversely, in the embodiment, the current is adjusted based on the currents and the voltages. In the embodiment, the temperature of the semiconductor light-emitting elements may not be determined. A light-emitting module can be provided in which the desired characteristics can be obtained easily without determining the temperature. For example, a light-emitting module can be provided in which the characteristics of the operation initial state can be maintained easily.

An example of the control of the control circuit 70 according to the embodiment will now be described.

As described above, for example, information that relates to the light output, the peak wavelength, the full width at half maximum of the spectral characteristic, and the skewness of the spectral characteristic when the temperature and the forward currents If change for the first to third semiconductor light-emitting elements 11 to 13 is acquired. The currents can be controlled by the following method based on this information.

Figure 6:
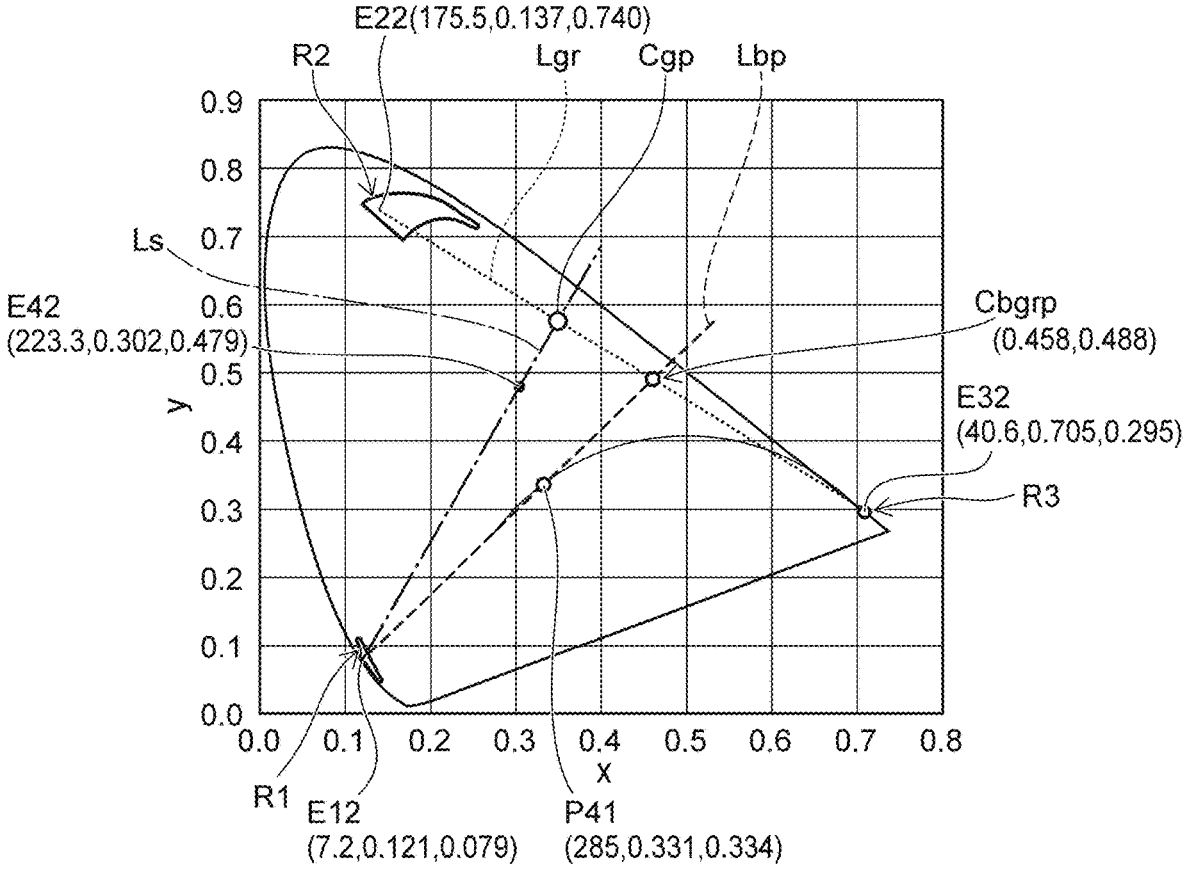
FIG. 6 is a schematic view illustrating the operation of the light-emitting module according to the first embodiment.
Figure 7:
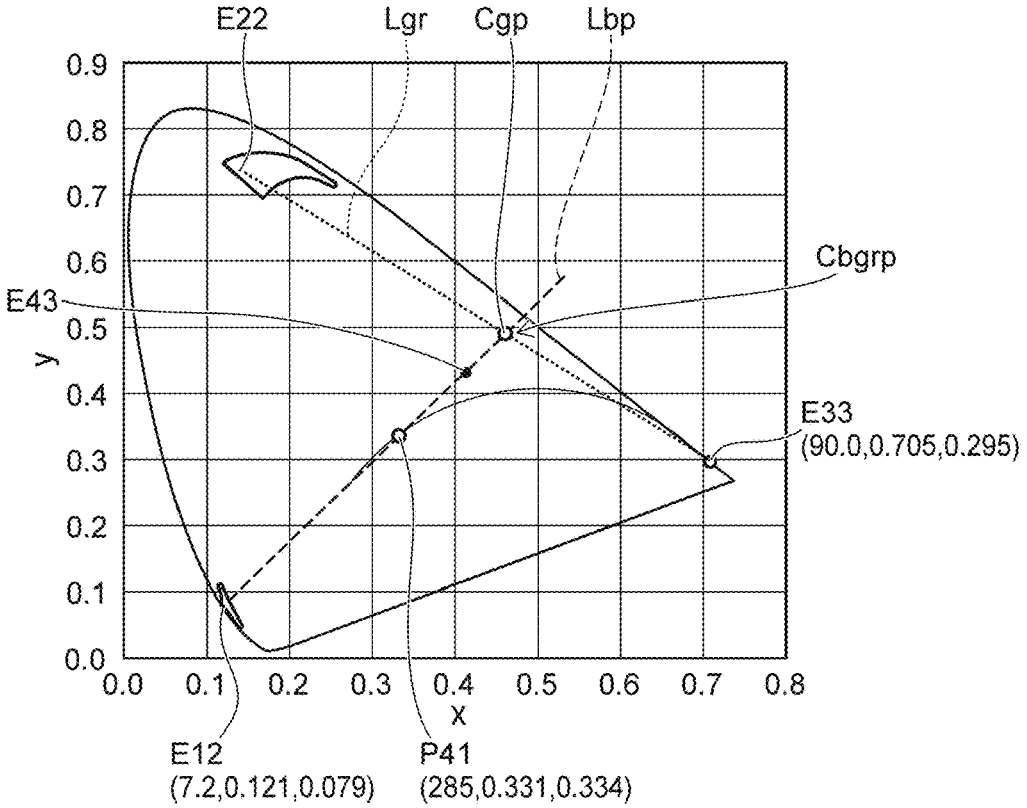
FIG. 7 is a schematic view illustrating the operation of the light-emitting module according to the first embodiment.
Figure 8:
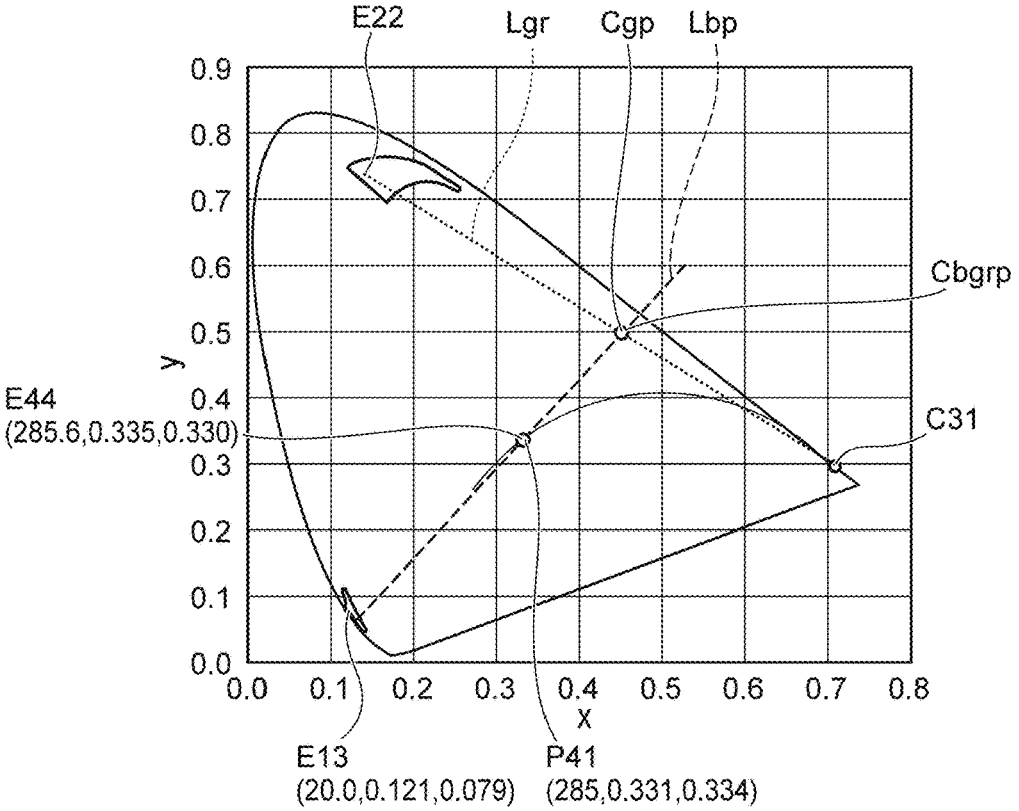
FIG. 8 is a schematic view illustrating the operation of the light-emitting module according to the first embodiment.

FIG. 6 to FIG. 8 are schematic views illustrating the operation of the light-emitting module according to the first embodiment.

As shown in FIG. 6, the chromaticity of the first light L1 of the first semiconductor light-emitting element 11 changes within the area of a region R1 in the area of the rated current and the area of the rated temperature. The chromaticity of the second light L2 of the second semiconductor light-emitting element 12 changes within the area of a region R2 in the area of the rated current and the area of the rated temperature. The chromaticity of the third light L3 of the third semiconductor light-emitting element 13 changes within the area of a region R3 in the area of the rated current and the area of the rated temperature.

A procedure such as the following is performed.

Setting Step

The chromaticity and the luminous flux of the synthesized light are determined in the first state (the operation initial state). The chromaticity and the luminous flux of the synthesized light in the first state may be, for example, specification values determined by a user. The chromaticity and the luminous flux of the synthesized light in the first state may be measured values of the chromaticity and the luminous flux in the first state of the synthesized light of the first to third semiconductor light-emitting elements 11 to 13 made based on specification values. For example, the chromaticity and the luminous flux can be measured by a measurement system using a photometric sphere.

For example, for a synthesized light P41 in the first state as shown in FIG. 6, the luminous flux Lf is 285 lm; and the chromaticity is (0.331, 0.334). These values are used as the target values.

First Step

The forward current If and the forward voltage Vf at the "current time" are measured for the first to third semiconductor light-emitting elements 11 to 13. For example, the "current time" corresponds to the second state (the continued-operation state). For example, the first to third currents I1 to I3 and the first to third voltages V1 to V3 in the second state are measured by the control circuit 70. The first to third currents I1 to I3 in the second state correspond to the current I12, the current I22, and the current I32 in the second state illustrated in FIG. 2. The first to third voltages V1 to V3 in the second state correspond to the voltage V12, the voltage V22, and the voltage V32 in the second state illustrated in FIG. 5.

The luminous flux and the chromaticity of the synthesized light at the "current time" are calculated from the measurement results of the forward current If and the forward voltage Vf at the "current time." The calculation is performed based on the information recited above relating to the light output, the peak wavelength, the full width at half maximum of the spectral characteristic, and the skewness of the spectral characteristic for the first to third semiconductor light-emitting elements 11 to 13, etc.

The calculated luminous flux and chromaticity at the "current time" are shown in FIG. 6. The calculated luminous flux Lf of a synthesized light E42 is, for example, 223.3 lm. The calculated chromaticity of the synthesized light E42 is, for example, (0.302, 0.479). Thus, the calculated luminous flux and chromaticity of the synthesized light E42 are shifted from the luminous flux (285 lm) and the chromaticity ((0.331, 0.334)) of the synthesized light P41 in the first state.

The chromaticity and the luminous flux Lf also can be calculated for the first to third lights L1 to L3 in the second state. For a calculated first light E12, the luminous flux Lf is 7.2 lm; and the chromaticity is (0.121, 0.079). For a calculated second light E22, the luminous flux Lf is 175.5 lm; and the chromaticity is (0.137, 0.740). For a calculated third light E32, the luminous flux Lf is 40.6 lm; and the chromaticity is (0.705, 0.295).

Thus, in the first step, the luminous flux Lf and the chromaticity at the "current time" (the second state) are calculated (estimated) based on the currents and the voltages.

For example, the chromaticity of the synthesized light of the second light L2 and the third light L3 is on a line segment Lgr illustrated in FIG. 6. The line segment Lgr passes through the calculated chromaticity of the second light E22 and the calculated chromaticity of the third light E32. The line segment Lgr has the relationship of $y=-0.8563x+0.8985$. On the other hand, the calculated chromaticity of the first light E12 and the calculated chromaticity of the synthesized light E42 are on a line segment Lbp. The line segment Lbp has the relationship of $y=2.8623x-0.2725$. The chromaticity of an intersection Cbgrp between the line segment Lgr and the line segment Lbp is (0.458, 0.488).

Second Step

For example, it is assumed that the second current I2 (for green) is modified so that the calculated luminous flux Lf of the synthesized light E42 at the "current time" (the second state) (223.3 lm) approaches the luminous flux Lf of the synthesized light P41 of the first state (285 lm). The chromaticity of the synthesized light when assuming that the second current I2 is modified does not match the chromaticity ((0.331, 0.334)) of the synthesized light P41 of the first state used as the target. Therefore, the first current I1 and the third current I3 are controlled so that the chromaticity of the synthesized light approaches the chromaticity of the synthesized light P41 of the first state.

An example of the procedure will now be described. To simplify the description, first, it is assumed that the chromaticity of the synthesized color (white) when assuming that the second current I2 is modified maintains the calculated chromaticity ((0.302, 0.479)) of the synthesized light E42. At this time, the chromaticity of an intersection Cgp of the line segment Lgr and a line segment Ls passing through the calculated chromaticity of the first light E12 and the calculated chromaticity of the synthesized light E42 is different from the chromaticity of the intersection Cbgrp.

The third current I3 (for red) is controlled so that the chromaticity of the intersection Cgp overlaps the intersection Cbgrp. The control of the third current I3 is performed based on, for example, the ratio of the distance between the intersection Cgp and one end of the line segment Lgr (e.g., the calculated chromaticity of the second light E22) to the length of the line segment Lgr and based on the ratio of the distance between the intersection Cbgrp and the other end of the line segment Lgr (e.g., the calculated chromaticity of the third light E32) to the length of the line segment Lgr. For example, the third current I3 (for red) is increased based on these ratios so that the chromaticity of the intersection Cgp approaches the chromaticity of the intersection Cbgrp.

FIG. 7 illustrates the state after increasing the third current 13 (for red). As shown in FIG. 7, the calculated luminous flux Lf of a third light E33 after increasing the third current I3 is 90.0 lm. At this time, the chromaticity of the intersection Cgp substantially overlaps the chromaticity of the intersection Cbgrp.

After increasing the third current I3 as shown in FIG. 7, the calculated chromaticity of a synthesized light E43 moves from the state of FIG. 6. In other words, the calculated chromaticity of the synthesized light E43 after increasing the third current I3 is on a new line segment Lbp. At this time, the calculated chromaticity of the synthesized light E43 after increasing the third current I3 does not match the chromaticity of the synthesized light P41 of the first state used as the target.

Then, the first current I1 (for blue) is controlled so that the calculated chromaticity of the synthesized light E43 after increasing the third current I3 approaches the chromaticity of the synthesized light P41 of the first state used as the target. The control of the first current I1 is performed based on, for example, the ratio of the distance between the calculated chromaticity of the synthesized light E43 and one end of the line segment Lbp (e.g., the calculated chromaticity of the first light E12) to the length of the line segment Lbp and based on the ratio of the distance between the calculated chromaticity of the synthesized light E43 and the other end of the line segment Lbp (e.g., the chromaticity of the intersection Cbgrp) to the length of the line segment Lbp. For example, the first current I1 (for blue) is increased based on these ratios so that the calculated chromaticity of the synthesized light E43 approaches the chromaticity of the synthesized light P41 of the first state.

FIG. 8 illustrates the state after increasing the first current I1 (for blue). As shown in FIG. 8, the calculated luminous flux Lf of a first light E13 after increasing the first current I1 is 20.0 lm. At this time, the calculated chromaticity of a synthesized light E44 is (0.335, 0.330) and approaches the chromaticity (0.331, 0.334) of the synthesized light P41 of the first state used as the target. Then, the calculated luminous flux Lf of the synthesized light E44 is 285.6 lm and approaches the luminous flux Lf of the synthesized light P41 of the first state used as the target (285 lm).

A set of the first step and the second step recited above may be repeated. Thus, the first to third currents I1 to I3 to be corrected can be calculated based on the measurement results of the first to third currents I1 to I3 and the first to third voltages V1 to V3 at the "current time" (the second state). The first to third currents I1 to I3 to be corrected are post-correction currents.

In the third state, the post-correction currents are supplied from the first to third circuits 21 to 23 to the first to third semiconductor light-emitting elements 11 to 13. Thereby, for example, the luminous flux Lf and the chromaticity that shifted from the operation initial state to the continued-operation state (the second state) substantially can be returned to the operation initial state.

In the embodiment, it is possible to calculate (estimate) the luminous flux and the chromaticity in the second state based on the first to third currents I1 to I3 and the first to third voltages V1 to V3 in the second state. In the example recited above, the synthesized light of the first to third lights L1 to L3 is white; and in such a case, the second light L2 that corresponds to green is focused upon. For example, in the example recited above, the calculated luminous flux Lf of the synthesized light (white) approaches the target by adjusting the calculated luminous flux Lf of the second light L2. In the embodiment, light of any color may be the object. In such a case, the luminous flux of the synthesized light used as the target can be corrected by adjusting the luminous flux Lf of the light that is the major component of the target synthesized light. Then, by adjusting the luminous flux of the light of other colors not adjusted by the correction, the chromaticity of the synthesized light can be caused to approach the chromaticity used as the target.

For example, in the case where the first to third lights L1 to L3 are blue, green, and red, the control circuit 70 reduces the second current I2 according to the decrease of the second voltage V2. Then, according to the decrease of the second voltage V2, the first current I1 is increased; and the third current I3 is increased.

For example, in the case where the first to third lights L1 to L3 are blue, green, and red, the control circuit 70 increases the second current I2 according to the increase of the second voltage V2. Then, according to the increase of the second voltage V2, the first current I1 is reduced; and the third current I3 is reduced.

The first state and the second state are arbitrary; for example, the levels of the temperatures are interchangeable.

Figure 9:
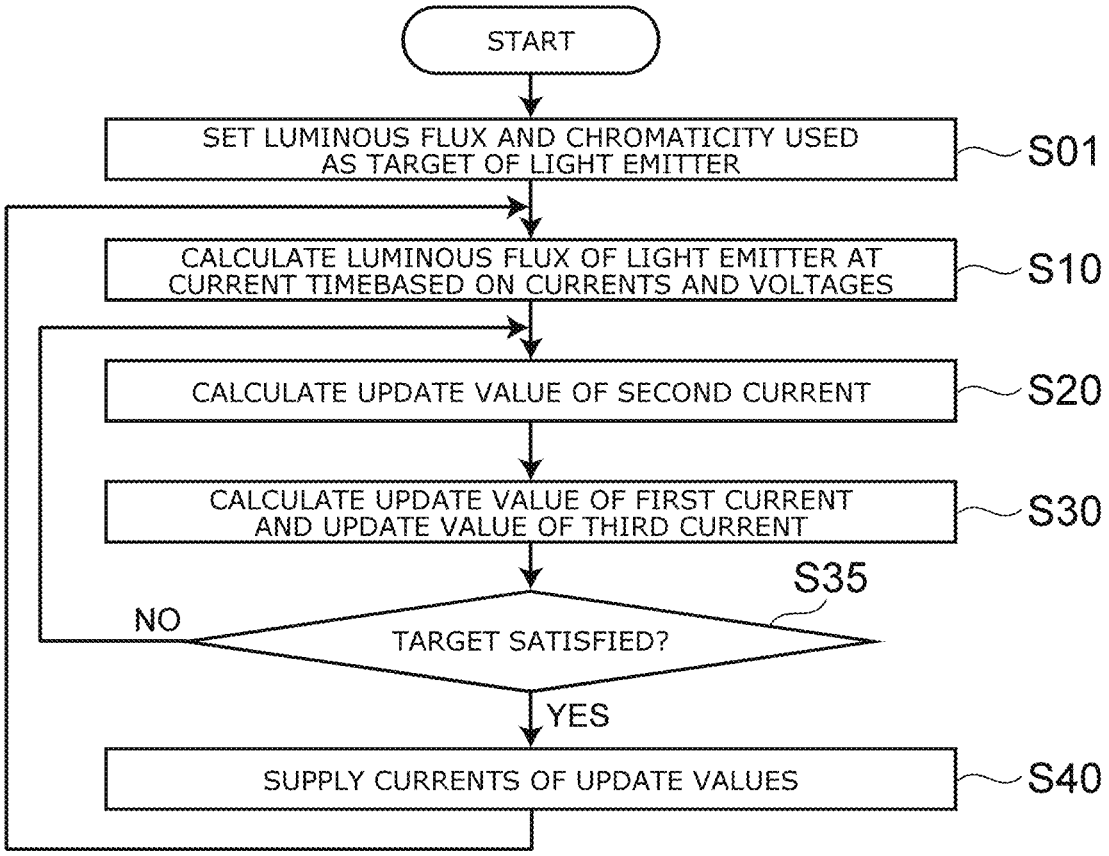
FIG. 9 is a flowchart illustrating the operations of the light-emitting module and the control circuit according to the first embodiment.

FIG. 9 is a flowchart illustrating the operations of the light-emitting module and the control circuit according to the first embodiment.

As shown in FIG. 9, first, the target chromaticity and the luminous flux Lf used as the target of the light emitter 10 are set (step S01). For example, specification values are determined for the luminous flux Lf and the chromaticity of the light (the synthesized light) of the light emitter 10 including the first to third semiconductor light-emitting elements 11 to 13. The target chromaticity and the luminous flux Lf used as the target of the light emitter 10 may be actual measured values of the light of the light emitter 10. Step S01 corresponds to the "setting step" described above.

The control circuit 70 performs the following processing (steps S10 to S40).

In step S10, the luminous flux Lf of the light emitter 10 at the "current time" is calculated based on pre-acquired characteristics and the first current I1, the first voltage V1, the second current I2, the second voltage V2, the third current I3, and the third voltage V3 at the "current time." In the calculation, the chromaticity of the light emitter 10 at the "current time" may be calculated.

The pre-acquired characteristics recited above include, for example, a pre-acquired relationship between the first current I1 and the first voltage V1 of the first semiconductor light-emitting element 11 and the luminous flux Lf and the chromaticity of the first semiconductor light-emitting element 11 (i.e., the first light L1). The pre-acquired characteristics recited above include, for example, a pre-acquired relationship between the second current I2 and the second voltage V2 of the second semiconductor light-emitting element 12 and the luminous flux Lf and the chromaticity of the second semiconductor light-emitting element 12 (i.e., the second light L2). The pre-acquired characteristics recited above include, for example, a pre-acquired relationship between the third current I3 and the third voltage V3 of the third semiconductor light-emitting element 13 and the luminous flux and the chromaticity of the third semiconductor light-emitting element 13 (i.e., the third light L3).

In step S10, for example, the processing of the first step described in reference to FIG. 6 is performed; and the luminous flux Lf of the light emitter 10 at the "current time" is calculated.

In step S20, the update value that relates to the second current I2 is calculated based on the measured value of the second voltage V2 at the "current time," the calculated luminous flux Lf of the light emitter 10 at the "current time," and the luminous flux of the light emitter 10 used as the target.

In step S30, for example, the luminous flux Lf and the chromaticity of the light emitter 10 after the update are calculated based on the update value relating to the second current I2 and the second voltage V2 after the update using the update value relating to the second current I2. Then, at least one of the update value relating to the first current I1 or the update value relating to the third current I3 is calculated based on the luminous flux Lf and the chromaticity of the light emitter 10 after the update and the luminous flux Lf and the chromaticity of the light emitter 10 used as the target.

In step S20 and step S30, for example, the processing of the second step described in reference to FIG. 7 and FIG. 8 is performed.

In step S35, it is determined whether or not the calculation result of the luminous flux Lf and the chromaticity of the light emitter 10 obtained when supplying the calculated first to third currents I1 to I3 obtained as recited above satisfies the target. In the case where the target is not satisfied, for example, the flow returns to step S20. When satisfied, the flow proceeds to step S40.

In step S40, the current of the update value is supplied to the first to third semiconductor light-emitting elements 11 to 13. For example, the control circuit 70 causes the first circuit 21 to supply, to the first semiconductor light-emitting element 11, the first current I1 of the calculated update value relating to the first current I1. The control circuit 70 causes the second circuit 22 to supply, to the second semiconductor light-emitting element 12, the second current I2 of the calculated update value relating to the second current I2. The control circuit 70 causes the third circuit 23 to supply, to the third semiconductor light-emitting element 13, the third current I3 of the calculated update value relating to the third current I3.

The control circuit 70 may repeat the processing (steps S10 to S40) recited above. The control circuit 70 may repeat steps S10 to S30.

Figure 10A:
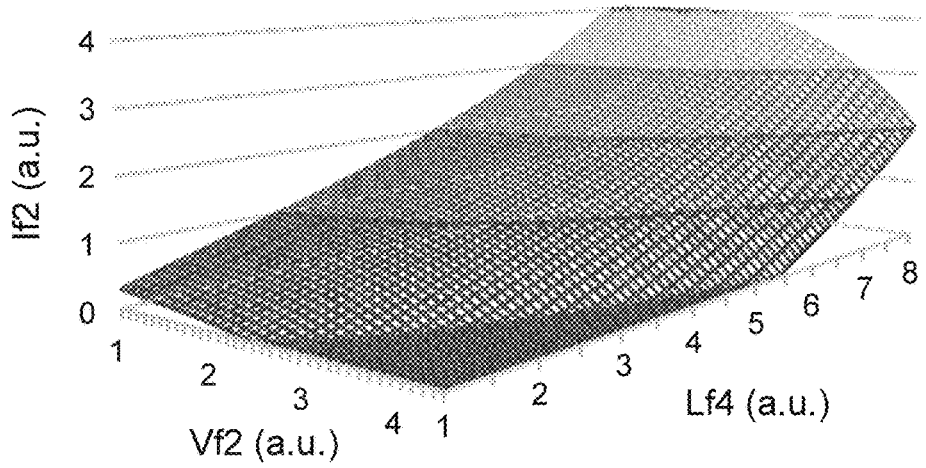
FIG. 10A is a schematic view illustrating the operation of the light-emitting module according to the first embodiment.
Figure 10B:
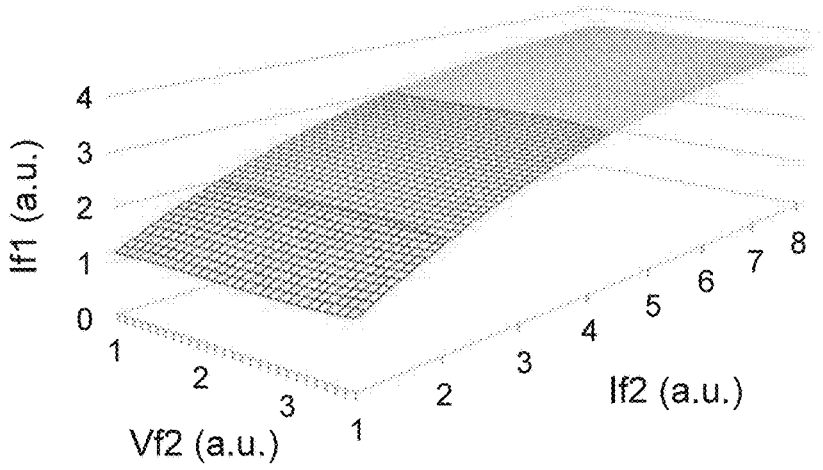
FIG. 10B is a schematic view illustrating the operation of the light-emitting module according to the first embodiment.
Figure 10C:
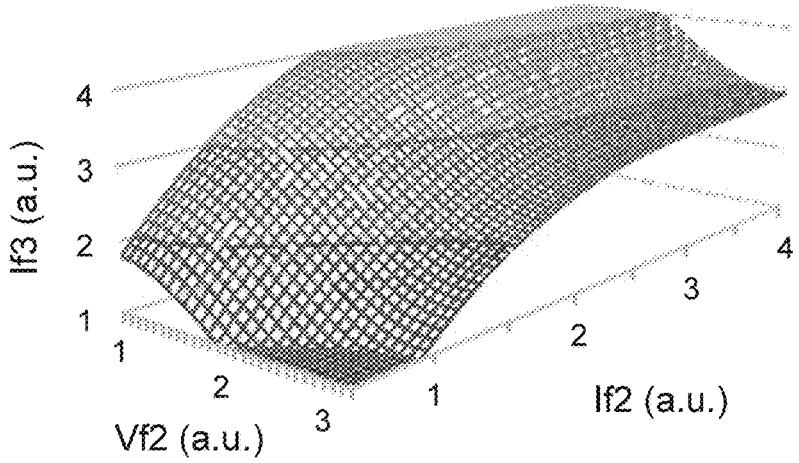
FIG. 10C is a schematic view illustrating the operation of the light-emitting module according to the first embodiment.

FIG. 10A to FIG. 10C are schematic views illustrating the operation of the light-emitting module according to the first embodiment.

These figures illustrate information used in at least a part of the processing performed by the control circuit 70 recited above.

In FIG. 10A, one axis corresponds to a forward current If2 of the second semiconductor light-emitting element 12; another axis corresponds to a forward voltage Vf2 of the second semiconductor light-emitting element 12; and another axis corresponds to a luminous flux Lf4 of the light (i.e., the synthesized light) of the light emitter 10. In step S20 recited above, for example, the luminous flux and the chromaticity of the synthesized light at the "current time" are calculated based on the information illustrated in FIG. 10A.

In FIG. 10B, one axis is a forward current If1 of the first semiconductor light-emitting element 11; another axis is the forward voltage Vf2 of the second semiconductor light-emitting element 12; and another axis is the forward current If2 of the second semiconductor light-emitting element 12. FIG. 10B shows the relationship of these currents and voltages when the color temperature is constant.

In FIG. 10C, one axis is a forward current If3 of the third semiconductor light-emitting element 13; another axis is the forward voltage Vf2 of the second semiconductor light-emitting element 12; and another axis is the forward current If2 of the second semiconductor light-emitting element 12. FIG. 10C shows the relationship of these currents and voltages when the color temperature is constant.

In step S30 recited above, for example, the update value relating to the first current I1 is calculated based on the information illustrated in FIG. 10B; and the update value relating to the third current I3 is calculated based on the information illustrated in FIG. 10C.

This information is a part of the information relating to the light output, the peak wavelength, the full width at half maximum of the spectral characteristic, and the skewness of the spectral characteristic for the first to third semiconductor light-emitting elements 11 to 13. For example, this information may be supplied from the computer 62 connected to the control circuit 70, etc. The actual measured values of this information, etc., may be supplied to the computer 62 from the control circuit 70. Any method of communication is applicable between the control circuit 70 and the computer 62.

In the embodiment, light that is near the luminous flux Lf and the chromaticity in the first state is obtained by the update recited above.

For example, the following may be performed in the control according to the embodiment. For example, the luminous flux is fixed; and a control is performed so that the color temperature is constant. Further, a control may be performed so that the luminous flux is changed arbitrarily and the color temperature is constant. The procedure described above may be performed for such controls.

For example, when the light emitter 10 is in the first state having the first temperature, the first circuit 21 supplies a fourth current to the first semiconductor light-emitting element 11; the second circuit 22 supplies a fifth current to the second semiconductor light-emitting element 12; and the third circuit 23 supplies a sixth current to the third semiconductor light-emitting element 13. For example, the fourth current, the fifth current, and the sixth current correspond respectively to the first current I1, the second current I2, and the third current I3 in the first state (the operation initial state).

For example, when the light emitter 10 is in the second state having the second temperature, the first circuit 21 supplies a seventh current to the first semiconductor light-emitting element 11; the second circuit 22 supplies an eighth current to the second semiconductor light-emitting element 12; and the third circuit 23 supplies a ninth current to the third semiconductor light-emitting element 13. The second temperature is higher than the first temperature. For example, the seventh current, the eighth current, and the ninth current correspond respectively to the first current I1, the second current I2, and the third current I3 (the post-correction currents) after correcting.

The luminous flux Lf and the chromaticity when supplying the fourth current, the fifth current, and the sixth current in the second state having the second temperature which is the high temperature are shifted from the luminous flux Lf and the chromaticity when supplying the fourth current, the fifth current, and the sixth current in the first state having the first temperature which is the low temperature. By supplying the seventh current, the eighth current, and the ninth current after correcting in the second state having the second temperature which is the high temperature, values near the luminous flux and the chromaticity in the first state which is the low temperature are obtained.

For example, the luminous flux of the light (the synthesized light) emitted from the light emitter 10 in the first state (e.g., the operation initial state) is taken as a first luminous flux. The luminous flux of the light (the synthesized light) emitted from the light emitter 10 in the second state (e.g., the continued-operation state) after correcting is taken as a second luminous flux. The absolute value of the difference between the first luminous flux and the second luminous flux is small.

On the other hand, in the second state (the continued-operation state), the luminous flux of the light (the synthesized light) emitted from the light emitter 10 when the fourth current (the current before correcting) is supplied to the first semiconductor light-emitting element 11, the fifth current (the current before correcting) is supplied to the second semiconductor light-emitting element 12, and the sixth current (the current before correcting) is supplied to the third semiconductor light-emitting element 13 is taken as a third luminous flux.

The absolute value of the difference between the first luminous flux and the second luminous flux is less than the absolute value of the difference between the first luminous flux and the third luminous flux (before correcting). According to the embodiment, by supplying the seventh current, the eighth current, and the ninth current after correcting, the luminous flux used as the target or a luminous flux near the target is substantially obtained.

For example, the chromaticity of the light (the synthesized light) emitted from the light emitter 10 in the first state is taken as a first chromaticity. The chromaticity of the light (the synthesized light) emitted from the light emitter 10 in the second state after correcting is taken as a second chromaticity. The absolute value of the difference between the first chromaticity and the second chromaticity is small.

On the other hand, in the second state (the continued-operation state), the chromaticity of the light (the synthesized light) emitted from the light emitter 10 when the fourth current (the current before correcting) is supplied to the first semiconductor light-emitting element 11, the fifth current (the current before correcting) is supplied to the second semiconductor light-emitting element 12, and the sixth current (the current before correcting) is supplied to the third semiconductor light-emitting element 13 is taken as a third chromaticity.

The absolute value of the difference between the first chromaticity and the second chromaticity is less than the absolute value of the difference between the first chromaticity and the third chromaticity (before correcting). According to the embodiment, by supplying the seventh current, the eighth current, and the ninth current after correcting, the chromaticity of the target or a light chromaticity near the target is substantially obtained.

Second Embodiment

The second embodiment relates to a control module 210 (referring to FIG. 1). The control module 210 includes the first to third circuits 21 to 23 and the control circuit 70 (referring to FIG. 1).

The first circuit (a first current regulator) 21 is electrically connected to the first semiconductor light-emitting element 11 configured to emit the first light L1. The second circuit (a second current regulator) 22 is electrically connected to the second semiconductor light-emitting element 12 configured to emit the second light L2. The third circuit (a third current regulator) 23 is electrically connected to the third semiconductor light-emitting element 13 configured to emit the third light L3 (referring to FIG. 1).

The control circuit 70 causes at least one of the first to third currents I1 to I3 to fluctuate according to the fluctuation of at least one of the first to third voltages V1 to V3 based on the first current I1 flowing in the first semiconductor light-emitting element 11, the first voltage V1 of the first semiconductor light-emitting element 11, the second current I2 flowing in the second semiconductor light-emitting element 12, the second voltage V2 of the second semiconductor light-emitting element 12, the third current I3 flowing in the third semiconductor light-emitting element 13, and the third voltage V3 of the third semiconductor light-emitting element 13.

For example, the second peak wavelength of the second light L2 is longer than the first peak wavelength of the first light L1. The third peak wavelength of the third light L3 is longer than the second peak wavelength.

For example, the control circuit 70 increases the first current I1 and increases the third current I3 according to the decrease of the second voltage V2. The control circuit 70 reduces the second current I2 according to the decrease of the second voltage V2.

For example, the control circuit 70 reduces the first current I1 and reduces the third current I3 according to the increase of the second voltage V2. The control circuit 70 reduces the second current I2 according to the increase of the second voltage V2.

According to the embodiments, a light-emitting module and a control module can be provided in which the desired characteristics can be obtained easily.

Hereinabove, exemplary embodiments of the invention are described with reference to specific examples. However, the embodiments of the invention are not limited to these specific examples. For example, one skilled in the art may similarly practice the invention by appropriately selecting specific configurations of components included in light-emitting modules and control modules such as semiconductor light-emitting elements, circuit parts, control circuits, etc., from known art. Such practice is included in the scope of the invention to the extent that similar effects thereto are obtained.

Further, any two or more components of the specific examples may be combined within the extent of technical feasibility and are included in the scope of the invention to the extent that the purport of the invention is included.

Moreover, all light-emitting modules, and control modules practicable by an appropriate design modification by one skilled in the art based on the light-emitting modules, and the control modules described above as embodiments of the invention also are within the scope of the invention to the extent that the purport of the invention is included.

Various other variations and modifications can be conceived by those skilled in the art within the spirit of the invention, and it is understood that such variations and modifications are also encompassed within the scope of the invention.

Obviously, numerous modifications and variations of the present invention are possible in light of the above teachings. It is therefore to be understood that within the scope of the appended claims, the invention may be practiced otherwise than as specifically described herein.

What is claimed is:

1. A light-emitting module comprising:

a light emitter comprising:

a first semiconductor light-emitting element configured to emit a first light with a first current flowing through the first semiconductor light-emitting element to cause a first voltage drop over the first semiconductor light-emitting element;

a second semiconductor light-emitting element configured to emit a second light with a second current flowing through the second semiconductor light-emitting element to cause a second voltage drop over the second semiconductor light-emitting element; and a third semiconductor light-emitting element configured to emit a third light with a third current flowing through the third semiconductor light-emitting element to cause a third voltage drop over the third semiconductor light-emitting element;

a first current regulator electrically connected to the first semiconductor light-emitting element to supply the first current to the first semiconductor light-emitting element;

a second current regulator electrically connected to the second semiconductor light-emitting element to supply the second current to the second semiconductor light-emitting element; and a third current regulator electrically connected to the third semiconductor light-emitting element to supply the third current to the third semiconductor light-emitting element; and a control circuit that includes:

a first current amplifier configured to receive a first current signal output from the first current regulator;

a second current amplifier configured to receive a second current signal output from the second current regulator;

a third current amplifier configured to receive a third current signal output from the third current regulator;

a first voltage amplifier configured to receive the first voltage drop;

a second voltage amplifier configured to receive the second voltage drop;

a third voltage amplifier configured to receive the third voltage drop;

an analog-to-digital converter configured to receive outputs from the first current amplifier, the second current amplifier, the third current amplifier, the first voltage amplifier, the second voltage amplifier, and the third voltage amplifier; and a pulse width modulator configured to receive an output of the analog-to-digital converter such that the control circuit is configured to control at least one of the first current regulator to control the first current, the second current regulator to control the second current, or the third current regulator to control the third current according to at least one of fluctuation of the first voltage drop, fluctuation of the second voltage drop, or fluctuation of the third voltage drop.

2. The light-emitting module according to claim 1, wherein the control circuit is configured to increase the first current and the third current according to a decrease of the second voltage.

3. The light-emitting module according to claim 2, wherein the control circuit is configured to reduce the second current according to the decrease of the second voltage.

4. The light-emitting module according to claim 1, wherein a peak wavelength of the second light is different from a peak wavelength of the first light, and a peak wavelength of the third light is different from the peak wavelength of the first light and different from the peak wavelength of the second light.

5. The light-emitting module according to claim 1, wherein a peak wavelength of the second light is longer than a peak wavelength of the first light, and a peak wavelength of the third light is longer than the peak wavelength of the second light.

6. The light-emitting module according to claim 1, wherein when the light emitter is in a first state having a first temperature, the first current regulator supplies a first amount of the first current to the first semiconductor light-emitting element, the second current regulator supplies a second amount of the second current to the second semiconductor light-emitting element, and the third current regulator supplies a third amount of the third current to the third semiconductor light-emitting element to synthesize the first light, the second light, and the third light into a first synthesized light, when the light emitter is in a second state having a second temperature, the first current regulator supplies a fourth amount of the first current to the first semiconductor light-emitting element, the second current regulator supplies a fifth amount of the second current to the second semiconductor light-emitting element, and the third current regulator supplies a sixth amount of the third current to the third semiconductor light-emitting element to synthesize the first light, the second light, and the third light into a second synthesized light, the second temperature being higher than the first temperature, and an absolute value of a difference between a first luminous flux of the first synthesized light and a second luminous flux of the second synthesized light is less than an absolute value of a difference between the first luminous flux and a third luminous flux of a third synthesized light, the light emitter being configured to synthesize the first light, the second light, and the third light into the third synthesized light when the first amount of the first current is supplied to the first semiconductor light-emitting element, the second amount of the second current is supplied to the second semiconductor light-emitting element, and the third amount of the third current is supplied to the third semiconductor light-emitting element in the second state.

7. The light-emitting module according to claim 1, wherein when the light emitter is in a first state having a first temperature, the first current regulator supplies a first amount of the first current to the first semiconductor light-emitting element, the second current regulator supplies a second amount of the second current to the second semiconductor light-emitting element, and the third current regulator supplies a third amount of the third current to the third semiconductor light-emitting element to synthesize the first light, the second light, and the third light into a first synthesized light, when the light emitter is in a second state having a second temperature, the first current regulator supplies a fourth amount of the first current to the first semiconductor light-emitting element, the second current regulator supplies a fifth amount of the second current to the second semiconductor light-emitting element, and the third current regulator supplies a sixth amount of the third current to the third semiconductor light-emitting element to synthesize the first light, the second light, and the third light into a second synthesized light, the second temperature being higher than the first temperature, and an absolute value of a difference between a first chromaticity of the first synthesized light and a second chromaticity of the second synthesized light is less than an absolute value of a difference between the first chromaticity and a third chromaticity of a third synthesized light, the light emitter being configured to synthesize the first light, the second light, and the third light into the third synthesized light when the first amount of the first current is supplied to the first semiconductor light-emitting element, the second amount of the second current is supplied to the second semiconductor light-emitting element, and the third amount of the third current is supplied to the third semiconductor light-emitting element in the second state.

8. The light-emitting module according to claim 7, wherein an absolute value of a difference between a first luminous flux of the first synthesized light and a second luminous flux of the second synthesized light is less than an absolute value of a difference between the first luminous flux of the first synthesized light and a third luminous flux of the third synthesized light.

9. The light-emitting module according to claim 1, wherein the control circuit is configured to control at least one of the first current regulator to control the first current, the second current regulator to control the second current, or control the third current regulator to control the third current by performing a process comprising:

calculating a current luminous flux of a current synthesized light into which the light emitter synthesizes the first light, the second light, and the third light at a current time based on:

a current amount of the first current at the current time;

a current amount of the first voltage at the current time;

a current amount of the second current at the current time;

a current amount of the second voltage at the current time;

a current amount of the third current at the current time;

a current amount of the third voltage at the current time;

a first relationship between a first luminous flux of the first light and both of an amount of the first current and an amount of the first voltage;

a second relationship between a first chromaticity of the first light and both of the amount of the first current and the amount of the first voltage;

a third relationship between a second luminous flux of the second light and both of an amount of the second current and an amount of the second voltage;

a fourth relationship between a second chromaticity of the second light and both of an amount of the second current and an amount of the second voltage;

a fifth relationship between a third luminous flux of the third light and both of an amount of the third current and an amount of the third voltage; and a sixth relationship between a third chromaticity of the third light and both of the amount of the third current and the amount of the third voltage;

calculating an updated amount of the second current based on the current amount of the second voltage, the current luminous flux of the current synthesized light, and a target luminous flux;

calculating an updated luminous flux and an updated chromaticity of an updated synthesized light to be emitted from the light emitter in which the second current regulator is to supply the updated amount of the second current based on the updated amount of the second current and an updated amount of the second voltage after the updated amount of the second current flows through the second semiconductor light-emitting element;

calculating at least one of an updated amount of the first current or an updated amount of the third current based on the updated luminous flux and the updated chromaticity of the updated synthesized light and the target luminous flux and a target chromaticity; and controlling the first current regulator to supply the updated amount of the first current to the first semiconductor light-emitting element, controlling the second current regulator to supply the updated amount of the second current to the second semiconductor light-emitting element, and controlling the third regulator to supply the updated amount of the third current to the third semiconductor light-emitting element.

10. The light-emitting module according to claim 9, wherein the control circuit is configured to repeat the process.

11. A control module, comprising:

a first current regulator to supply a first current to a first semiconductor light-emitting element configured to emit a first light to cause a first voltage drop over the first semiconductor light-emitting element;

a second current regulator to supply a second current to a second semiconductor light-emitting element configured to emit a second light to cause a second voltage drop over the second semiconductor light-emitting element;

a third current regulator to supply a third current to a third semiconductor light-emitting element configured to emit a third light to cause a third voltage drop over the third semiconductor light-emitting element; and a control circuit that includes:

a first current amplifier configured to receive a first current signal output from the first current regulator;

a second current amplifier configured to receive a second current signal output from the second current regulator;

a third current amplifier configured to receive a third current signal output from the third current regulator;

a first voltage amplifier configured to receive the first voltage drop;

a second voltage amplifier configured to receive the second voltage drop;

a third voltage amplifier configured to receive the third voltage drop;

an analog-to-digital converter configured to receive outputs from the first current amplifier, the second current amplifier, the third current amplifier, the first voltage amplifier, the second voltage amplifier, and the third voltage amplifier; and a pulse width modulator configured to receive an output of the analog-to-digital converter such that the control circuit is configured to control at least one of the first current regulator to control the first current, the second current regulator to control the second current, or the third current regulator to control the third current according to at least one of fluctuation of the first voltage drop, fluctuation of the second voltage drop, or fluctuation of the third voltage drop.

12. The control module according to claim 11, wherein the control circuit is configured to increase the first current and the third current according to a decrease of the second voltage.

13. The control module according to claim 12, wherein the control circuit is configured to reduce the second current according to the decrease of the second voltage.

14. The control module according to claim 11, wherein a peak wavelength of the second light is longer than a peak wavelength of the first light, and a peak wavelength of the third light is longer than the peak wavelength of the second light.

15. The light-emitting module according to claim 1, wherein the light emitter is configured to synthesize the first light, the second light, and the third light into an original synthesized light before the at least one of fluctuation of the first voltage drop, fluctuation of the second voltage drop, or fluctuation of the third voltage drop occurs, and the control circuit is configured to control the at least one of the first current regulator to control the first current, the second current regulator to control the second current, or the third current regulator to control the third current to synthesize the first light, the second light, and the third light into a controlled synthesized light such that a chromaticity of the original synthesized light is closer to a chromaticity of the controlled synthesized light than to a chromaticity of an uncontrolled synthesized light, the light emitter being configured to synthesize the first light, the second light, and the third light into the uncontrolled synthesized light if the control circuit does not control the at least one of the first current regulator to control the first current, the second current regulator to control the second current, or the third current regulator when the at least one of fluctuation of the first voltage drop, fluctuation of the second voltage drop, or fluctuation of the third voltage drop occurs.

16. The light-emitting module according to claim 11, wherein the light emitter is configured to synthesize the first light, the second light, and the third light into an original synthesized light before the at least one of fluctuation of the first voltage drop, fluctuation of the second voltage drop, or fluctuation of the third voltage drop occurs, and the control circuit is configured to control the at least one of the first current regulator to control the first current, the second current regulator to control the second current, or the third current regulator to control the third current to synthesize the first light, the second light, and the third light into a controlled synthesized light such that a chromaticity of the original synthesized light is closer to a chromaticity of the controlled synthesized light than to a chromaticity of an uncontrolled synthesized light, the light emitter being configured to synthesize the first light, the second light, and the third light into the uncontrolled synthesized light if the control circuit does not control the at least one of the first current regulator to control the first current, the second current regulator to control the second current, or the third current regulator when the at least one of fluctuation of the first voltage drop, fluctuation of the second voltage drop, or fluctuation of the third voltage drop occurs.

17. The light-emitting module according to claim 1, wherein the control circuit is configured to increase the first current and the third current according to a decrease of the second voltage in order to correct for a change in luminous flux and/or chromaticity from a first state of operation of the light emitter to a second state of operation of the light emitter by changing the luminous flux and/or chromaticity back to the first state.

18. The control module according to claim 11, wherein the control circuit is configured to increase the first current and the third current according to a decrease of the second voltage in order to correct for a change in luminous flux and/or chromaticity from a first state of operation of a light emitter including the first semiconductor light-emitting element, the second semiconductor light-emitting element, and the third semiconductor light-emitting element to a second state of operation of the light emitter by changing the luminous flux and/or chromaticity back to the first state.

* * * * *